US010028876B1

(12) United States Patent
Berry

(10) Patent No.: US 10,028,876 B1
(45) Date of Patent: Jul. 24, 2018

(54) BED PAN ASSEMBLY

(71) Applicant: Ronald Berry, Oklahoma City, OK (US)

(72) Inventor: Ronald Berry, Oklahoma City, OK (US)

( * ) Notice: Subject to any disclaimer, the term of this patent is extended or adjusted under 35 U.S.C. 154(b) by 0 days.

(21) Appl. No.: 15/459,569

(22) Filed: Mar. 15, 2017

(51) Int. Cl.
*A61G 9/00* (2006.01)
*A47K 13/02* (2006.01)

(52) U.S. Cl.
CPC ..... *A61G 9/003* (2013.01); *A47K 13/02* (2013.01); *A61G 2200/12* (2013.01)

(58) Field of Classification Search
CPC ..... A61G 9/003; A61G 9/006
USPC ..... 604/327; 4/456
See application file for complete search history.

(56) References Cited

U.S. PATENT DOCUMENTS 940,958 A 11/1909 Duval
2,491,799 A 12/1949 Clarke
3,005,992 A * 10/1961 Sullivan ..... A61B 10/007 229/117.01
D275,606 S 9/1984 Zawachi
6,021,530 A 2/2000 Davis
6,151,721 A 11/2000 Whitfield
6,280,425 B1 8/2001 Del Guercio
6,643,849 B2 11/2003 Sands
2005/0066432 A1* 3/2005 Gouldsworthy ..... A61G 9/003 4/450
2010/0107326 A1* 5/2010 Joseph ..... A61G 9/003 4/457
2012/0144575 A1* 6/2012 Sanchez Moreno ... A61G 9/003 4/452
2015/0305956 A1* 10/2015 Su ..... A61G 9/006 4/144.1

FOREIGN PATENT DOCUMENTS

WO WO0170157 9/2001

* cited by examiner

*Primary Examiner* — Janie Loeppke

(57) ABSTRACT

A bedpan assembly for women in post op, women confined to a bed, and generally for elderly female patients is provided. The bedpan assembly includes a bedpan tray to which a pillow is attached at a proximal end of the bedpan tray. The bedpan tray provides a funnel at its distal end that is connected to a collection bottle for urine collection. The bedpan is constructed and arranged to allow for urine flow into the bedpan tray and proceed into the collection bottle between the legs of a patient. The bedpan assembly offers greater dignity and comfort to the patient, and greater convenience and time savings for medical personnel.

8 Claims, 4 Drawing Sheets

BED PAN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bedpan devices and more particularly pertains to a new bedpan assembly for use particularly by women. A need exists for a bedpan assembly for women, particularly for women in post-operative environments, and women who are confined to a bed, and generally for elderly female patients, which offers more dignity and comfort to the patient, and greater convenience and time savings for medical personnel.

BRIEF SUMMARY OF THE INVENTION

An embodiment of the disclosure meets the needs presented above by generally comprising a bedpan tray having a proximal end, a distal end, a first side, a second side, an upper interior surface having interior ridges, an upper edge, a bottom surface, a first coupler, a second coupler and a distal funnel. A bed plan splatter guard has a first side, a second side, a curved proximal edge, a lower edge, a first downwardly extending side tab and a second downwardly extending side tab. The bedpan tray and the bedpan splatter guard are connected with the upper edge of the bedpan tray by a snap fit provided by the first side tab and the second side tab of the bedpan splatter guard. A bedpan pillow has a first connector and a second connector. The bedpan pillow is releasably secured to the bedpan tray by releasably securing the first and second connectors of the bedpan pillow to the first and second couplers of the bedpan tray. A bedpan collection bottle with a bottle neck shape receives the distal funnel of the bedpan tray.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
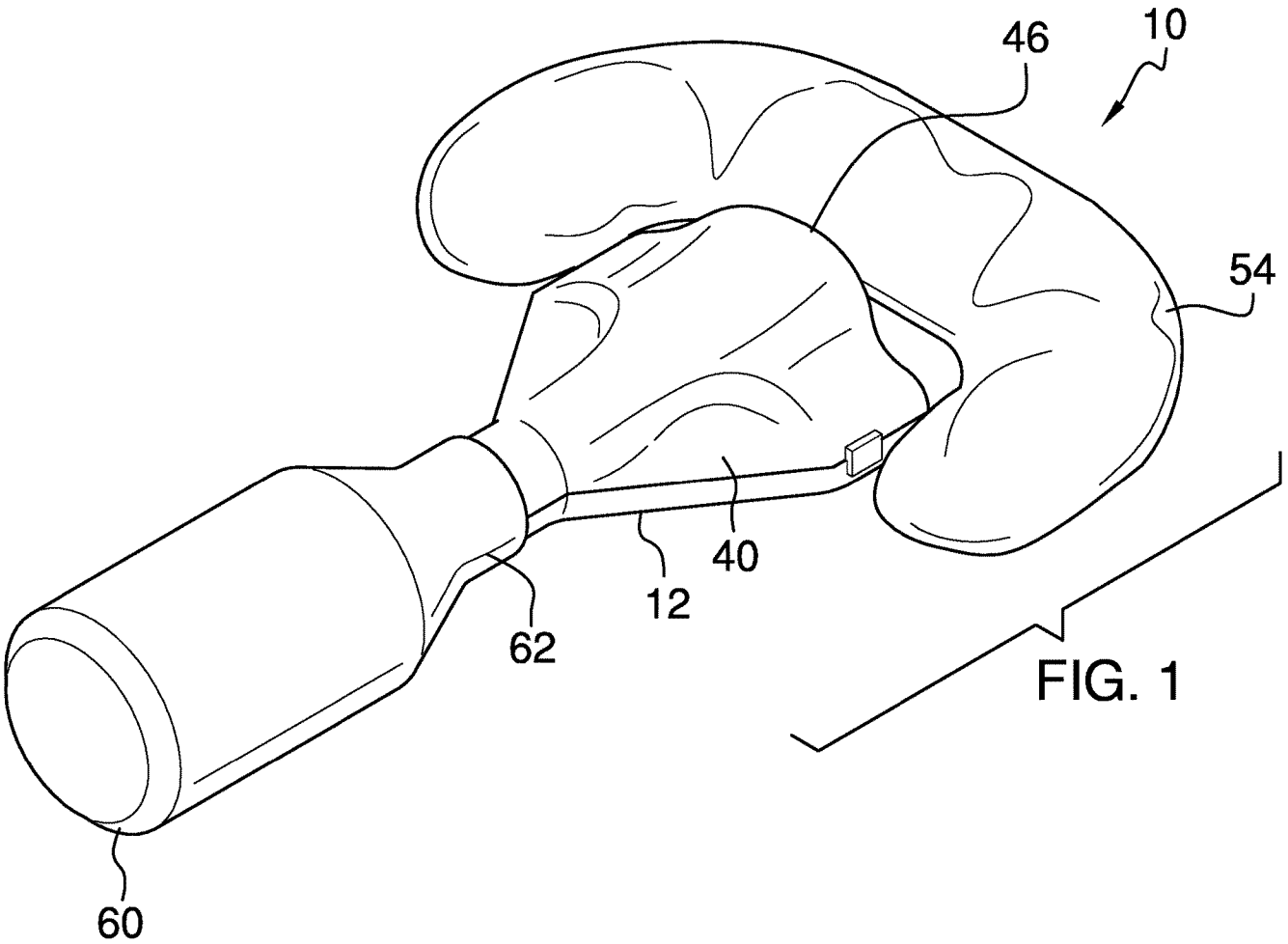
FIG. 1 is an isometric view of a bedpan assembly according to an embodiment of the disclosure.
Figure 2:
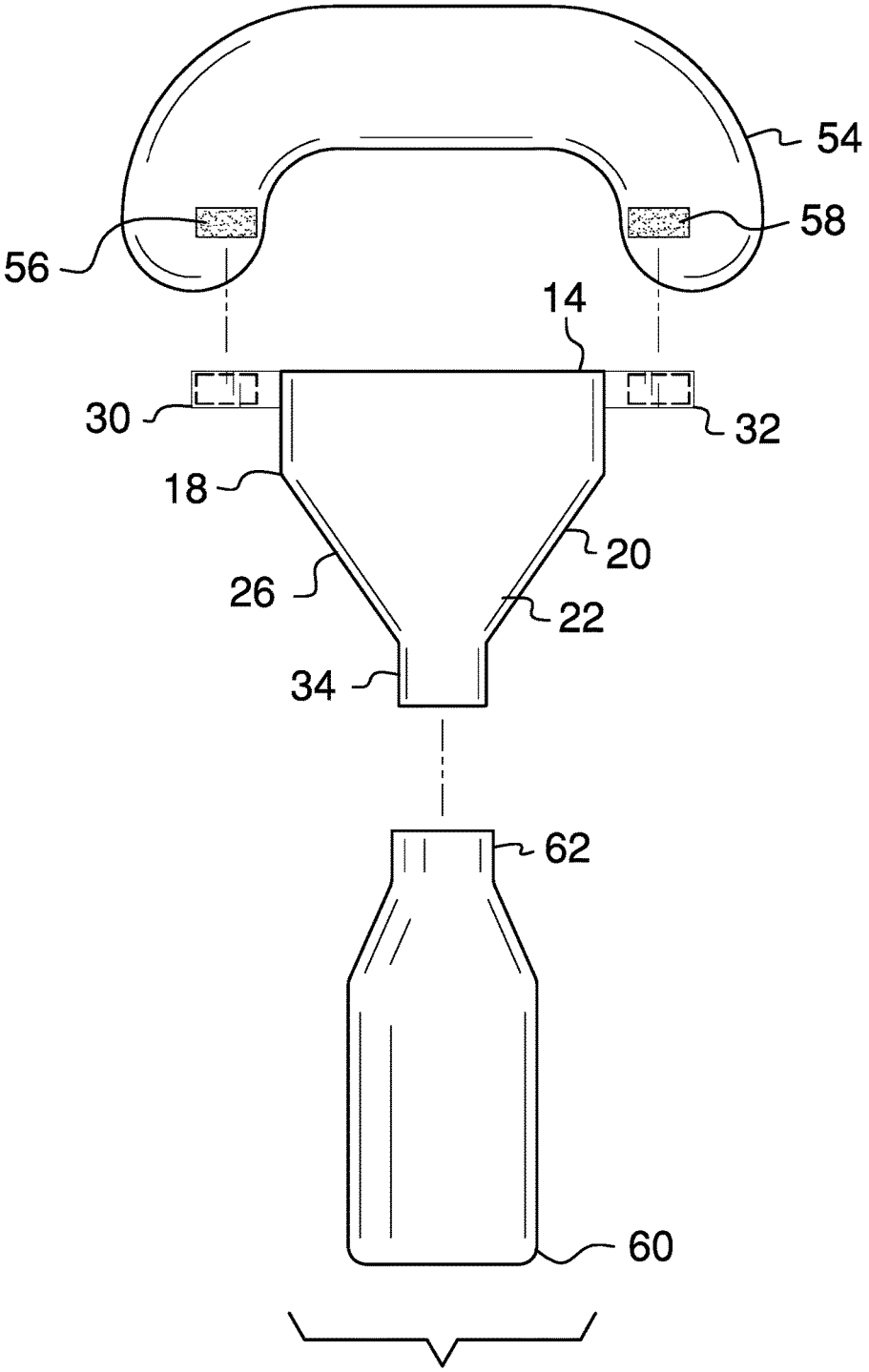
FIG. 2 is an exploded bottom view an embodiment of the disclosure.
Figure 3:
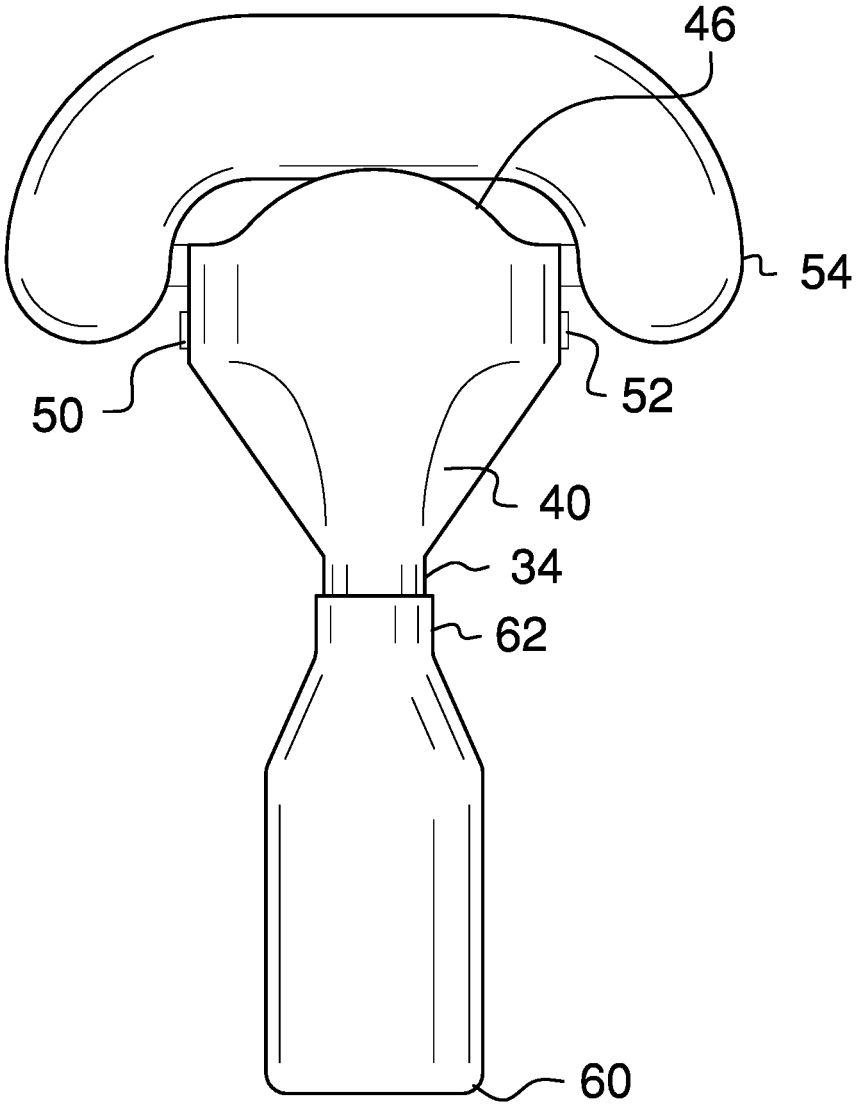
FIG. 3 is a top view of an embodiment of the disclosure.
Figure 4:
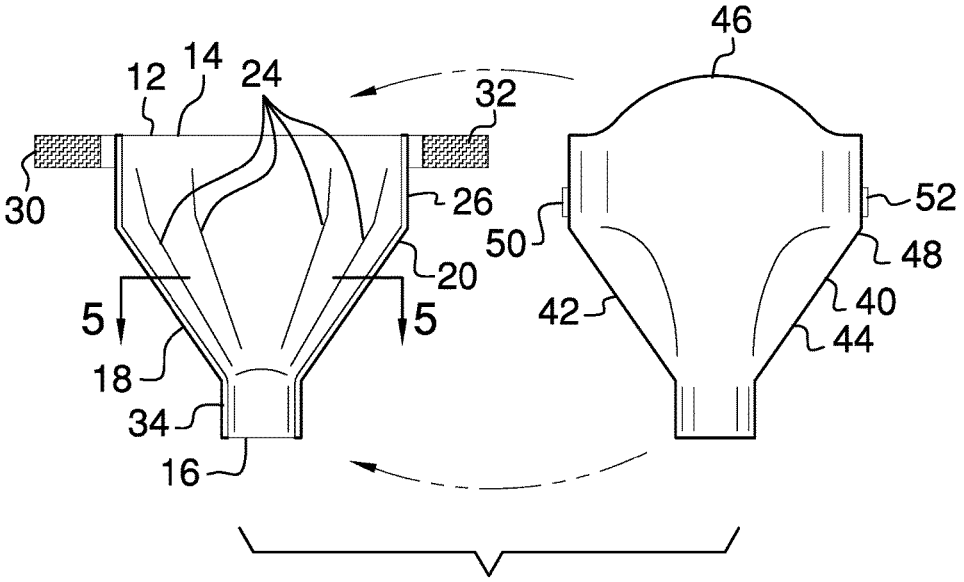
FIG. 4 is a detail view of an embodiment of the disclosure.
Figure 5:
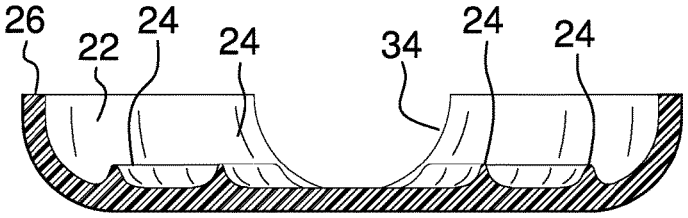
FIG. 5 is a cross sectional view taken along lines 5-5 of FIG. 4.

With reference now to the drawings, and in particular to FIGS. 1 through 5 thereof, a new bedpan assembly embodying the principles and concepts of an embodiment of the disclosure and generally designated by the reference numeral 10 will be described.

As best illustrated in FIGS. 1 through 5, the bedpan assembly 10 generally comprises a bedpan tray 12, a bedpan splatter guard 40, a bedpan pillow 58 and a collection bottle 64. The bedpan tray 12 has a proximal end 14, a distal end 16, a first side 18, a second side 20, an upper interior surface 22 with interior ridges 24, an upper edge 26, a bottom surface 28, a first coupler 30, a second coupler 32, and a distal funnel 34.

The bedpan splatter guard 40 has first and second sides 42, 44, a curved proximal edge 46, and a lower edge 48 from which first and second side tabs 50, 52 downwardly extend. The bedpan tray 12 is connected to the bedpan splatter guard 40 by a snap fit provided by the first and second side tabs 50, 52. The bedpan splatter guard 40 ensures that a sheet or blanket will not fold down and touch the bedpan tray 12 and will also give the patient privacy when the sheets and blanket are not being used to cover the lower half of the patient's body.

In one embodiment of the disclosure, the bedpan splatter guard 40 has a distal end 54 which defines an upper portion of the distal funnel 34 which, when connected to the bedpan tray 12, forms the distal funnel 34.

The bedpan pillow 58 has a first connector 58 and a second connectors 60 that are releasably secured to the bedpan tray 12 by first 30 and second 32 couplers. The first 30 and second 32 couplers and the first 58 and second 60 connectors may comprise mating portions of a hook and loop fasteners as shown in the Figures. The pillow 58 being connected to the bedpan tray 12 provides the bedpan tray 12 and its ridge 24 on each side and grooves 24 down the center forms an angle between approximately 5° and 12°. This angle allows the urine to flow easily down the bedpan tray 12 to the distal funnel 34 of the bedpan 10 and into the collection bottle 64.

The collection bottle 64 has a collection bottle neck 66 shaped to receive the distal funnel 34 of the bedpan tray 12. The collection bottle 64 is designed to have a volume to hold up to 1.1 quarts of urine before it must be emptied.

In use, the bedpan assembly 10 is constructed and arranged to allow for urine flow into the bedpan tray 12 and into the bottle 64 between the legs of the patient. The distal funnel of the bedpan tray 12 fits in the collection bottle 64 to prevent spills or leakage. The bedpan tray 12 fits comfortably with its ergonomic ridges and grooves and allows women urine relief without soiling a bed.

The bedpan tray 12 is attached to top edge of the bedpan pillow 58. Though a hook and loop couplers is shown, the bedpan tray 12 and pillow 58 may be attached by snaps, buttons, or any suitable connector.

The bedpan tray 12 and bedpan splatter guard 40 may be made of any suitable plastic material, and may be provided in different sizes to accommodate size variations of the patients. The collection bottle 64 may also be made of any suitable plastic material. The collection bottle 64 may be of any suitable shape, including a bottle having a flat lower surface. Alternatively, the collection bottle 64 may be a soft plastic collection bladder such that it is resiliently compressible.

The pillow 58 may also be made of plastic or any other suitable material. The pillow may be provided in different sizes to accommodate patients of different sizes. The pillow is shown having a C-shape, but the pillow may be provided in a square shape or horse-shoe shape.

The bedpan assembly 10 is clean, sanitary and easy to use while preventing spills or leakage. The bottle is periodically emptied, rinsed and replaced. The bedpan tray 12 may be rinsed at any time with antibacterial solution which will flow through the distal funnel and into the collection bottle 64.

In use, the distal funnel 34 is securely held in place. The patient may turn from side to side, without dislodging the distal funnel 34 from going into the collection bottle 64. The patient merely needs to be laying flat or sitting on the pillow 58*n* while using the bedpan tray 12. Many patients can change the bottle themselves if necessary and approved by the nurse or doctor.

The additional advantages provided by the bedpan assembly of the disclosure are many. The bedpan assembly provides benefits for female patients in post-operative environments, female patients who are confined to a bed, and generally for elderly female patients. Its construction to allow for urine flow into a pillow pan and into a bottle between the legs of the patient allows female patients to have more dignity and comfort during a very vulnerable and difficult time. The bedpan assembly also offers convenience and time saving measures for medical offices, ambulances, hospitals, nursing homes and hospice facilities. The bedpan assembly will create an enormous amount of savings, not only financially, but also in the time nurses and attendants may spend changing gowns, bedpans and bed sheets.

The bedpan assembly and its pillow, tray, splatter guard and bottle will revolutionize the medical industry in regards to nursing care for patients. The bedpan tray fits the patient comfortably and provides the patient urine relief without soilage or messy bedpans. The distal funnel of the bedpan tray fits nicely in the collection bottle to prevent spills and leakage. This is beneficial for female patients after surgery and while on medication. This also frees the amount of time a nurse or attendant must spend every step of the way with standard primitive and out of date bedpans. The nurse will be allowed to check the bottle only periodically at the nurse's convenience. This is better for both the nurse and for the patient. This allows the nurse an enormous amount of extra time to attend to other needed duties.

The plastic parts are easily cleaned and/or replaced. The parts may be provided in different sizes to accommodate patient size. The removable collection bottle provides easy use as it may be emptied and reused as needed and allows no bedpan spills or wet sheets.

This bedpan assembly provides the advantages of less trips to hospital room by nurses, and provides a comfortable, practical, low cost alternative to previous bedpans. The bedpan assembly may be conveniently sold in pharmacies and medical supply stores.

The bedpan assembly offers less discomfort as the patient will not have to lay on an uncomfortable old-fashioned bedpan. The patient does not have to call the nurse as often. The patient will never have to lay on wet sheets, and changing the sheets will not be needed due to a spill.

Patients who may benefit from this bedpan assembly include post-op patients on medication after knee or leg surgery, patients in nursing homes, patients who are paralyzed, disabled, in wheel chairs, and patients who are unable to stand or walk to the rest room. This bedpan assembly may also save female patients from having to use urinary catheters.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bedpan assembly configured for use by a woman, said bedpan assembly comprising:

a bedpan tray having a proximal end, a distal end, a first side, a second side, an upper interior surface having interior ridges, each of said interior ridges having a respective first end proximate to said proximal end of said bedpan and a respective second end proximate to said distal end of said bedpan, each of said interior ridges being formed by an angled pair of straight sections, said interior ridges being spaced and positioned to taper together approaching said distal end of said bedpan wherein said interior ridges are configured to funnel matter towards said distal end, an upper edge, a bottom surface, a first coupler, a second coupler and a distal funnel;

a bedpan splatter guard having a first side, a second side, a curved proximal edge, a lower edge, a first downwardly extending side tab and a second downwardly extending side tab, said bedpan tray and said bedpan splatter guard being connected by a snap fit provided by said first side tab and said second side tab of said bedpan splatter guard with said upper edge of said bedpan tray;

a bedpan pillow having a first connector and a second connector, said bedpan pillow being releasably secured to said bedpan tray by releasably securing said first and second connectors of the bedpan pillow to said first and second couplers of the bedpan tray; and a bedpan collection bottle with a bottle neck shape receives said distal funnel of said bedpan tray.

2. The bedpan assembly of claim 1, wherein said first and second connectors and said first and second couplers comprise hook and loop couplers.

3. The bedpan assembly of claim 1, wherein said collection bottle has a volume of less than 1.10 quarts.

4. The bedpan assembly of claim 3, wherein said bedpan tray, said bedpan splatter cover, said bedpan pillow and said bedpan collection bottle are comprised of a plastic material.

5. The bedpan assembly of claim 3, wherein said collection bottle has a flat lower surface.

6. The bedpan assembly of claim 3, wherein said collection bottle is a resiliently compressible plastic bladder.

7. The bedpan assembly of claim 3, wherein said bedpan pillow has a c-shape, or a square shape.

8. The bedpan assembly of claim 3, wherein said bedpan splatter guard has a distal end portion forming an upper portion of said distal funnel.

* * * * *